United States Patent [19]

Moss et al.

[11] Patent Number: 5,016,889

[45] Date of Patent: May 21, 1991

[54] GAME TILE STRUCTURE

[76] Inventors: Oden K. Moss, P.O. Box CB 11875, Nassau, The Bahamas; George Spector, 233 Broadway, New York City, N.Y. 10007

[21] Appl. No.: 586,562

[22] Filed: Sep. 21, 1990

[51] Int. Cl.[5] ..... A63F 9/20

[52] U.S. Cl. ..... 273/293; 273/301

[58] Field of Search ..... 273/293, 301, 292; 40/665

[56] References Cited

U.S. PATENT DOCUMENTS 1,217,810 2/1917 Noel ..... 273/301

FOREIGN PATENT DOCUMENTS 1076982 11/1954 France ..... 273/301
1368701 6/1964 France ..... 273/301
1203382 8/1970 United Kingdom ..... 273/293
2027348 2/1980 United Kingdom ..... 273/301

*Primary Examiner*—Benjamin Layno

[57] ABSTRACT

A music educational game is provided and consists of a plurality of small rectangular game tiles. Each tile has a face divided into halves. Each half is either blank or marked by a music note symbol representing a value count of one to six. Each half of the game tiles also has a continuous belt wrapped around the game tile in which two different music note symbols are each marked on opposite sides of the belt. The continuous belt is manually rotatable to change the music note symbol and its value count to vary the play of the game. Each player must match the face half of one tile with the face half of another tile during the play of the game until the first player left with no tiles wins the game.

1 Claim, 1 Drawing Sheet

GAME TILE STRUCTURE

BACKGROUND OF THE INVENTION

The present invention relates generally to games and more specifically it relates to a music educational game which provides a fun way for a person to learn music notes and their values.

There are available various conventional games which do not provide the novel improvements of the invention herein disclosed.

SUMMARY OF THE INVENTION

A primary object of the present invention is to provide a music educational game that will overcome the shortcomings of the prior art devices.

Another object is to provide a music educational game that is similar to the game of dominoes, except that the dots are replaced with music notes and their values so that it becomes a fun way for a person to learn the music notes and their values.

An additional object is to provide a music educational game in which each game tile had interchangeable music notes and their values thereon so that during the play of the game the data on the tile can be changed to enhance the fun in playing the game.

A further object is to provide a music educational game that is simple and easy to use.

A still further object is to provide a music educational game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
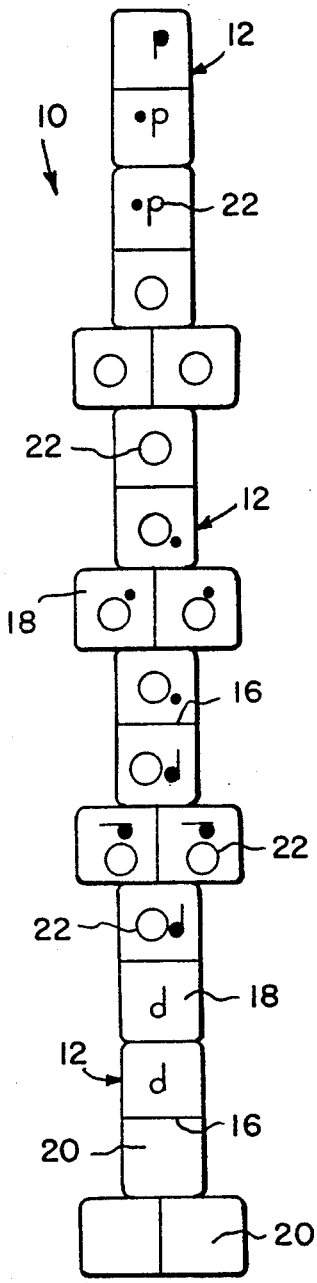
FIG. 1 is a top plan view of the invention being of a dominoes type game utilizing various tiles with different music note symbols instead of dots thereon.
Figure 2:
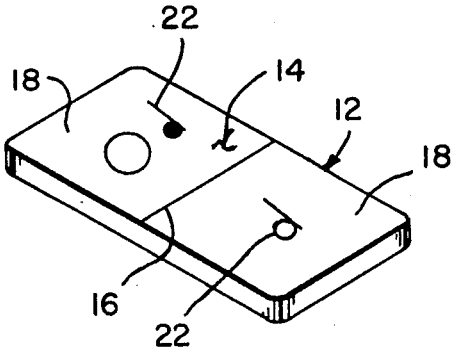
FIG. 2 is an enlarged perspective view of one of the game tiles.

Turning now descriptively to the drawings, in which similar reference characters denote similar elements throughout the several views, FIG. 1 illustrates a music educational game 10 similar to the game of dominoes, consisting of a plurality of small rectangular tiles 12. Each tile 12 (see also FIG. 2) has a face 14 divided at 16 into halves 18. Each half 18 is either blank 20 or marked by a music note symbol 22 representing a value count of one to six, whereby each player must match the face half 18 of one tile 12 with the face half 18 of another tile 12 during the play of the game 10 until the first player left with no tiles wins the game.

Figure 3:
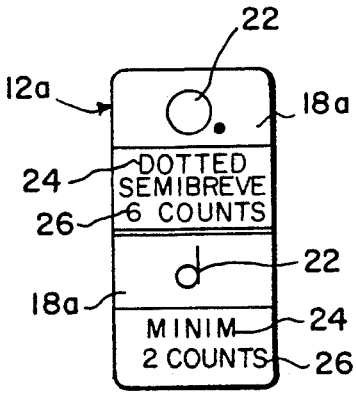
FIG. 3 is an enlarged top plan view of a modified game tile in which the value counts are marked net to their respective music note symbols thereon.

FIG. 3 shows a modified game tile 12*a* wherein each half face 18*a* includes the name 24 of the music note symbol and its value counts 26 marked thereon next to the respective music note symbol 22. Each player can visually match the music note symbol 22 and its value count 26 with another tile 12*a* with the same music note symbol 22 and its value count 26 during the play of the game 10.

Figure 4:
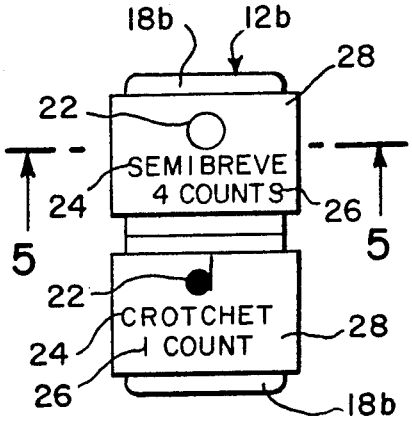
FIG. 4 is an enlarged top plan view of another modified game tile in which two continuous belts are provided in which two different music note symbols with their value counts are printed on each belt so that during the play of the game the game tile can be changed.
Figure 5:
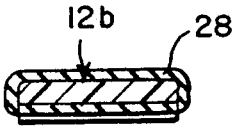
FIG. 5 is a cross-sectional view along lines 5—5 in FIG. 4 of the modified game title.

FIGS. 4 and 5 show still another modified game tile 12*b* wherein each half face 18*b* includes a continuous belt 28 in which two different music note symbols 22 are each marked on opposite sides thereon with their respective names 24 and value counts 26. During the play of the game 10 each continuous belt 28 cna be manually rotated to change the music note symbol 22 and its value count 26 to vary the play of the game.

The music note symbols 22 and their value counts 26 are as follows:

O.—Dotted simibreve or dotted whole note=6 counts

O𝅗𝅥—A semibreve and crotchet=5 counts

O—Semibreve or whole note=4 counts d.—Dotted minim or dotted half rote=3 counts d—Minim or half note=2 counts ♩—Crotchet or quarter note=1 count To play the game, each player must try to match the music note symbols 22 correctly from one tile 12 to another. The first player to finish wins the game. When four players are playing they will pick seven tiles each. When there players are playing they will pick nine tiles each and remove the double blank tile from the game. When two players are playing they will pick fourteen tiles each. The player with the double dotted semibreve or double dotted whole note will play first.

The game reinforces the learning of the music note symbols 22 and their value counts 26 for each player of the game while the players enjoy the play of the game 10.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A music educational game comprising a plurality of small rectangular game tiles, each said tile having a face divided into halves, each half being either blank or marked by a music note symbol representing a value count of one to six whereby each player must match the face half of one said tile with the face half of another said tile during the play of the game until the first player left with no tiles wins the game;

each half face on each said tile further includes the name of the music note symbol and its value count marked thereon next to the respective music note symbol so that each player can visually match the music note symbol and its value count with another said tile with the same music note symbol and its count during the play of the game;

each half face on each said tile further includes a continuous belt thereabout in which two different music note symbols are each marked on opposite sides thereon with their respective names and value counts so that during the play of the game each said continuous belt is manually rotatable to change the music note symbol and its value count to vary the play of the game.

* * * * *